US012060704B2

(12) United States Patent
Kanai et al.

(10) Patent No.: US 12,060,704 B2
(45) Date of Patent: Aug. 13, 2024

(54) FLUSH WATER CONTROL METHOD, CONTROL DEVICE, AND NON-TRANSITORY COMPUTER READABLE RECORDING MEDIUM

(71) Applicant: PANASONIC HOLDINGS CORPORATION, Osaka (JP)

(72) Inventors: Hirofumi Kanai, Osaka (JP); Toshihide Mori, Osaka (JP); Yuka Yamada, Nara (JP)

(73) Assignee: PANASONIC HOLDINGS CORPORATION, Osaka (JP)

( * ) Notice: Subject to any disclaimer, the term of this patent is extended or adjusted under 35 U.S.C. 154(b) by 100 days.

(21) Appl. No.: 17/986,616

(22) Filed: Nov. 14, 2022

(65) Prior Publication Data

US 2023/0071883 A1 Mar. 9, 2023

Related U.S. Application Data

(63) Continuation of application No. PCT/JP2021/001168, filed on Jan. 15, 2021.

(60) Provisional application No. 63/030,538, filed on May 27, 2020.

(30) Foreign Application Priority Data

Nov. 18, 2020 (JP) ..... 2020-191519

(51) Int. Cl.

| | |
|---|---|
| ***E03D 5/10*** | (2006.01) |
| ***E03D 3/12*** | (2006.01) |
| ***E03D 11/13*** | (2006.01) |

(52) U.S. Cl.

CPC ..... *E03D 5/105* (2013.01); *E03D 3/12* (2013.01); *E03D 11/13* (2013.01)

(58) Field of Classification Search

CPC ..... E03D 5/105; E03D 3/12; E03D 11/13; E03D 5/026; E03D 5/10

See application file for complete search history.

(56) References Cited

U.S. PATENT DOCUMENTS

| | | | | |
|---|---|---|---|---|
| 9,828,755 | B1 * | 11/2017 | Clements | E03D 9/08 |
| 11,604,177 | B1 * | 3/2023 | Park | G01N 31/22 |
| 2020/0123752 | A1 * | 4/2020 | Tsuiki | E03D 11/00 |
| 2023/0047540 | A1 * | 2/2023 | Herbst | A61B 5/0537 |

FOREIGN PATENT DOCUMENTS

| | | |
|---|---|---|
| JP | 2000-282538 | 10/2000 |

* cited by examiner

*Primary Examiner* — Christine J Skubinna

(74) *Attorney, Agent, or Firm* — Greenblum & Bernstein, P.L.C.

(57) ABSTRACT

A controller acquires image data captured by a camera which is located at a toilet to capture an image of a bowl of the toilet, determines whether an unacceptable matter being an object having a possibility of clogging the toilet is in the bowl by performing image recognition based on the image data, and sends, to a flush water controller, a flow prohibition signal of prohibiting flush water from flowing when it is determined that the unacceptable matter is in the bowl.

8 Claims, 9 Drawing Sheets

FLUSH WATER CONTROL METHOD, CONTROL DEVICE, AND NON-TRANSITORY COMPUTER READABLE RECORDING MEDIUM

TECHNICAL FIELD

This disclosure relates to a technology of controlling a flow of flush water into a toilet.

BACKGROUND ART

Toilets in elderly care facilities and hospitals are frequently clogged with unacceptable matters, such as paper diapers, put into the toilets by residents and patients. When a toilet is clogged, flush water may overflow from the toilet. In this regard, Patent Literature 1 discloses a water overflow preventive mechanism provided with a water level sensor at a toilet of a flush type for issuing an alarm and rendering a flush valve unopenable when a water level exceeds an upper limit water level.

However, the technology of Patent Literature 1 has difficulty in detecting an unacceptable matter in the toilet before the flush water flows thereinto, and therefore, still needs improvement for preventing the flush water from overflowing from the toilet and keeping the toilet from being clogged with such an unacceptable matter.

CITATION LIST

Patent Literature

Patent Literature 1: Japanese Unexamined Patent Publication No. 2000-282538

SUMMARY OF INVENTION

An object of the disclosure is to provide a technology of preventing flush water from overflowing from a toilet, and keeping the toilet from being clogged with an unacceptable matter.

A flush water control method according to an aspect of the disclosure is a flush water control method for a controller communicably connected to a flush water controller that controls a flow of flush water into a toilet of a flush type. The flush water control method includes: acquiring image data captured by a camera which is located at the toilet to capture an image of a bowl of the toilet; determining whether an unacceptable matter being an object having a possibility of clogging the toilet is in the bowl by performing image recognition based on the image data; and sending, to the flush water controller, a flow prohibition signal of prohibiting the flush water from flowing when it is determined that the unacceptable matter is in the bowl.

This disclosure makes it possible to prevent flush water from overflowing from a toilet, and keep the toilet from being clogged with an unacceptable matter.

DESCRIPTION OF EMBODIMENTS

Circumstances led up to this disclosure

Figure 1:
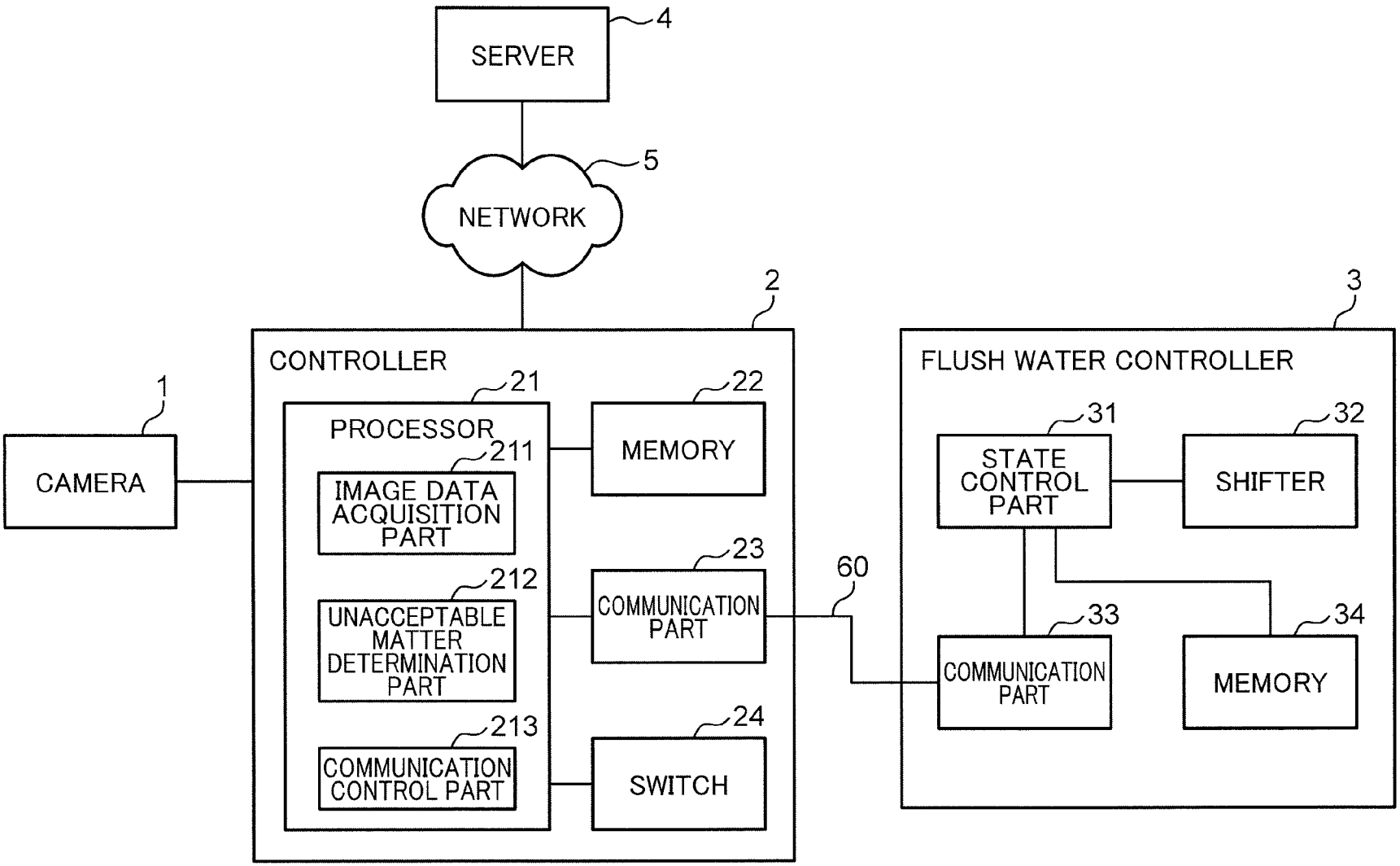
FIG. 1 shows a configuration of an excretion management system in a first embodiment of the disclosure.

Patent Literature 1 discloses detecting whether a water level of pooled water in a toilet exceeds an upper limit water level by using a water level sensor provided at an upper portion of a bowl of a toilet, and rendering and keeping a flush valve unopenable when the water level of the reserved water exceeds the upper limit water level. In this way, Patent Literature 1 aims at preventing flush water from overflowing from the toilet.

However, in Patent Literature an unacceptable matter put in the bowl prior to flushing of the flush water does not significantly raise the water level. Hence, the water level sensor fails to detect an excess of the pooled water over the upper limit water level unless the flush water is flushed after the putting of the unacceptable matter. That is to say, Patent Literature 1 cannot detect the unacceptable matter immediately after the putting of the unacceptable matter. This may cause the unacceptable matter to flow toward a drain hole along with the flow of the flush water and result in clogging the toilet.

Under the circumstances, the present inventors have obtained the knowledge that overflow of flush water is preventable and clogging of a toilet with an unacceptable matter is also preventable by using a camera to capture an image of an inner state of a bowl, analyzing acquired image data to determine whether or not the unacceptable matter is, and prohibiting the flush water from flowing when it is determined that the unacceptable matter is, and then, the present inventors have conceived of the following aspects of the disclosure.

A flush water control method according to one aspect of the disclosure is a flush water control method for a controller communicably connected to a flush water controller that controls a flow of flush water into a toilet of a flush type. The flush water control method includes: acquiring image data captured by a camera which is located at the toilet to capture an image of a bowl of the toilet; determining whether an unacceptable matter being an object having a possibility of clogging the toilet is in the bowl by performing image recognition based on the image data; and sending, to the flush water controller, a flow prohibition signal of prohibiting the flush water from flowing when it is determined that the unacceptable matter is in the bowl.

According to this configuration, it is determined whether an unacceptable matter is in the bowl by performing the image recognition based on the image data acquired by the camera, and sends, to the flush water controller, a flow prohibition signal when it is determined that the unacceptable matter is in the bowl. Hence, the flush water is prohibited from flowing immediately after detection of the put unacceptable matter. This consequently succeeds in, after the putting of the unacceptable matter, prohibiting the flush water from flowing before the flush water starts to flow, and thus preventing the flush water from overflowing from the toilet and keeping the toilet from being clogged with the unacceptable matter.

The flush water control method may further include: acquiring sensing data from a sensor which detects whether a user sits on the toilet; and determining whether a user sits on the toilet by using the sensing data when it is determined that the unacceptable matter is in the bowl; sending the flow prohibition signal when it is determined that no user sits on the toilet, and suspending sending of the flow prohibition signal when it is determined that a user sits on the toilet.

An unacceptable matter is highly likely to be put in a state where no user sits on the toilet. According to this configuration, the flow prohibition signal is not sent unless the user sits on the toilet even at acquisition of an image recognition result showing that the unacceptable matter is. This can prevent the flow prohibition signal from being sent regardless of, actually, no unacceptable matter. In addition, detection accuracy of the unacceptable matter is increased.

The flush water control method may further include: determining whether the unacceptable matter has been removed from the bowl by performing the image recognition based on the image data after sending the flow prohibition signal; and sending, to the flush water controller, a flow permission signal of permitting the flush water to flow when it is determined that the unacceptable matter has been removed.

According to this configuration, after the sending of the flow prohibition signal, it is determined whether the unacceptable matter has been removed by performing the image recognition based on the image data, and the flow permission signal is sent when it is determined that the unacceptable matter has been removed. Hence, the flush water controller in a flow prohibition state of prohibiting the flush water from flowing in response to the flow prohibition signal can automatically restore a flow permission state of permitting the flush water to flow after the removal of the unacceptable matter.

In the flush water control method, in the determining of the unacceptable matter, when the image data contains an image of an object having a predetermined size or larger except for stool and urine, the object may be determined as the unacceptable matter.

The unacceptable matter which may clog the toilet includes a paper diaper put in the bowl. The paper diaper has a color different from those of stool and urine, and further has a predetermined size or larger. According to this configuration, when the image data contains an image of an object having the predetermined size or larger except for stool and urine, the object is determined as the unacceptable matter. This configuration therefore enables accurate detection of the unacceptable matter which may clog the toilet.

In the flush water control method, the image data includes color image data having a plurality of color components, and in the determining of the unacceptable matter, a difference image between base image data indicating a state of the bowl having no stool, urine, and unacceptable matter, and the image data may be calculated, and it may be determined, based on luminance of each of the color components of the difference image, whether the image data contains an image of each of stool and urine.

According to this configuration, a difference image between the base image data indicating the state of the bowl having no stool, urine, and unacceptable matter, and the image data is calculated, and therefore an image of each of stool, urine, and an unacceptable matter being in the bowl is accurately extractable from the image data. Moreover, each of the stool and the urine has characteristics in high luminance of a specific color component. According to this configuration, it is determined, based on the luminance of each of the color components of the difference image, whether the image data contains an image of each of stool and urine. In this respect, this configuration enables an accurate detection of each of the stool and the urine, and further achieves accurate detection of an unacceptable matter.

In the flush water control method, the unacceptable matter may include a diaper.

According to the configuration, the diaper is recognized as an unacceptable matter. This results in a success of keeping toilets in elderly care facilities and hospitals from being frequently clogged with diapers.

A controller according to another aspect of the disclosure is a controller communicably connected to a flush water controller that controls a flow of flush water into a toilet of a flush type. The controller includes: an image data acquisition part that acquires image data captured by a camera which is located at the toilet to capture an image of a bowl of the toilet; an unacceptable matter determination part that determines whether an unacceptable matter being an object having a possibility of clogging the toilet is in the bowl by performing image recognition based on the image data; and a communication control part that sends, to the flush water controller, a flow prohibition signal of prohibiting the flush water from flowing when the unacceptable matter determination part determines that an unacceptable matter is in the bowl.

A flush water control program according to further another aspect of the disclosure is a flush water control program for causing a computer to serve as a controller communicably connected to a flush water controller that controls a flow of flush water into a toilet of a flush type. The flush water control program causes the computer to: acquire image data captured by a camera which is located at the toilet to capture an image of a bowl of the toilet; determine whether an unacceptable matter being an object having a possibility of clogging the toilet is in the bowl by performing image recognition based on the image data; and send, to the flush water controller, a flow prohibition signal of prohibiting the flush water from flowing when it is determined that the unacceptable matter is in the bowl.

This disclosure can be realized as a flush water control system caused to operate by a flush water control program as well. Additionally, it goes without saying that the computer program is distributable as a non-transitory computer readable storage medium like a CD-ROM, or distributable via a communication network like the Internet.

Each of the embodiments which will be described below represents a specific example of the disclosure. Numeric values, shapes, constituent elements, steps, and the order of the steps described below are mere examples, and thus should not be construed to delimit the disclosure. Moreover, constituent elements which are not recited in the independent claims each showing the broadest concept among the constituent elements in the embodiments are described as selectable constituent elements. The respective contents are combinable with each other in all the embodiments.

First Embodiment

Figure 2:
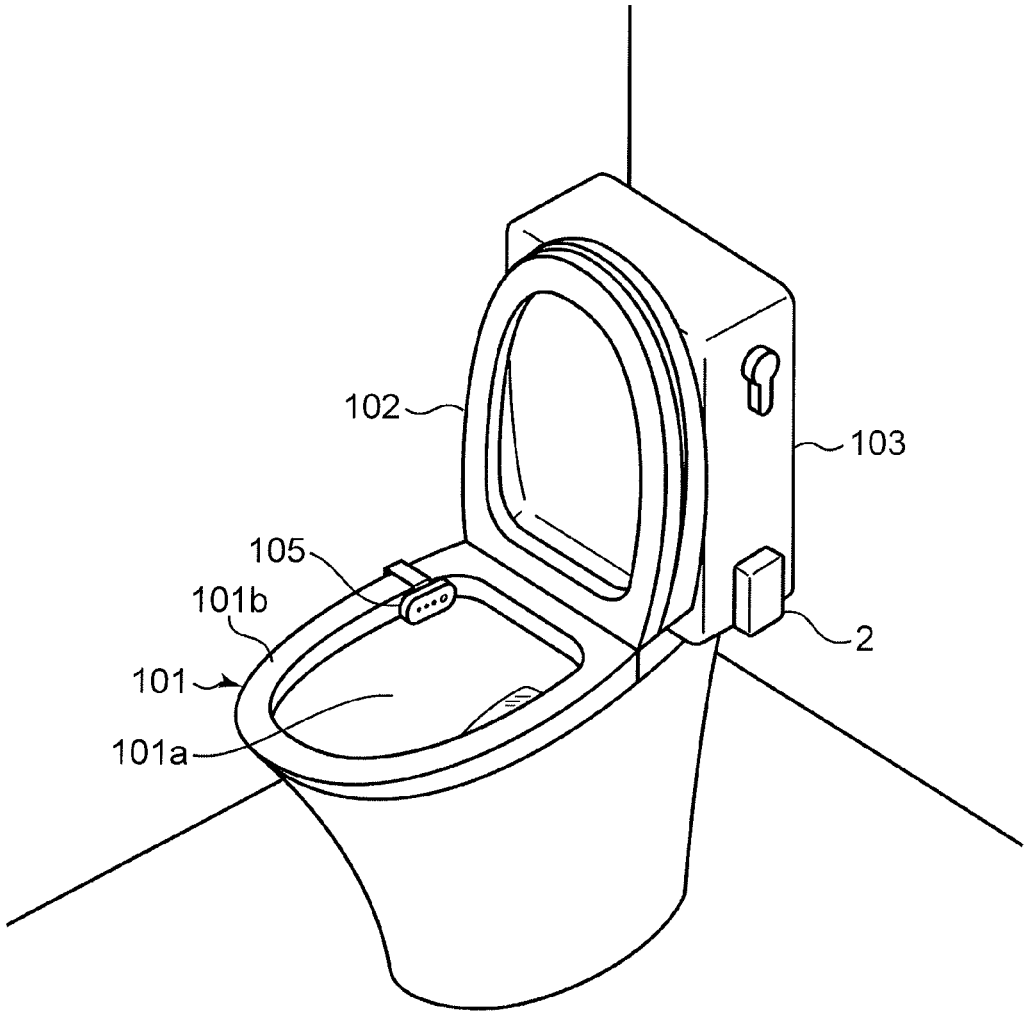
FIG. 2 is a view explaining arrangement positions of a sensor unit and a controller in the first embodiment of the disclosure.

FIG. 1 shows a configuration of an excretion management system in a first embodiment of the disclosure. FIG. 2 is a view explaining arrangement positions of a sensor unit 105 and a controller 2 in the first embodiment of the disclosure.

The excretion management system shown in FIG. 1 includes a camera 1, the controller 2, a flush water controller 3, and a server 4. As shown in FIG. 2, the toilet 101 includes a bowl 101*a* and a fringe part 101*b*. The fringe part 101*b* is located at an upper end of the toilet 101 and defines an opening section of the toilet 101. The bowl 101*a* is located below the fringe part 101*b* to receive stool and urine. The sensor unit 105 is attached on the fringe part 101*b*. The camera 1 is communicably connected to the controller 2 through a wireless or wired, communication therebetween.

The bowl 101*a* has a bottom provided with an unillustrated drain hole. The stool and the urine excreted in the bowl 101*a* is caused to flow to a sewage pipe through the drain hole. In other words, the toilet 101 is in the form of a toilet of a flush type. Moreover, a toilet seat 102 is provided on a top of the toilet 101 to allow a user to sit thereon. The toilet seat 102 is rotatable upward and downward. The user sits on the toilet seat 102 lowered to lie on the toilet 101. A water reservoir tank 103 that stores flush water to cause the stool and the urine to flow is provided in the rear of the toilet 101.

Referring back to FIG. 1, the camera 1 is located at the toilet 101 to capture an image of the bowl 101*a*. The camera 1 is arranged inside the sensor unit 105 shown in FIG. 2. For instance, the camera 1 has a high sensitivity and a wide angle, and is configured to capture a color image having an R (red) component, a G (green) component, and a B (blue) component. A camera for capturing an image of an object by irradiating the object with an infrared light emitting diode and a white light emitting diode is universally used in a field of detecting objects. However, such a conventional camera faces difficulty in detecting, in particular, an object having many red-based color components. Therefore, it is difficult to distinguish stool and urine from each other. From this perspective, a camera having a high sensitivity and a wide angle is adopted as the camera 1 in the embodiment. Specifically, the camera 1 includes a CMOS having a size of one fourth inch with a high sensitivity. The camera 1 is in the form of a wide-angle camera having a horizontal view angle of 120 degrees and a vertical view angle of 45 degrees. The numeral value of each of the inches and the angles shows a mere example, and another numerical value is adoptable. The camera 1 is communicably connected to the controller 2 through a wireless or wired communication therebetween. The camera 1 captures an image of an inner portion of the bowl 101*a* at a predetermined frame rate, and transmits the obtained image data. Here, the camera 1 always transmits captured image data to the controller 2.

The controller 2 serves as a controller of the toilet 101 that is communicably connected to the flush water controller 3. The controller 2 includes a processor 21, a memory 22, a communication part 23, and a switch 24.

For instance, the processor 21 includes a central processing unit (CPU) or an ASIC (application specific integrated circuit). The processor 21 includes an image data acquisition part 211, an unacceptable matter determination part 212, and a communication control part 213.

The image data acquisition part 211 acquires the image data captured by the camera 1.

The unacceptable matter determination part 212 determines whether an unacceptable matter being an object having a possibility of clogging the toilet 101 is in the bowl 101*a* by performing image recognition based on the image data. The image recognition will be described in detail later. The unacceptable matter includes an object having a possibility of clogging the toilet 101, e.g., a diaper, a large amount of toilet paper, a paper cup, or other object, except for stool and urine. The diaper may be a paper diaper or a cloth diaper.

Specifically, the unacceptable matter determination part 212 determines that an unacceptable matter is when the image data contains an image of an object having a predetermined size or larger except for stool and urine. For instance, the predetermined size corresponds to the smaller size of either a size representing a large amount of toilet paper or a size of a diaper, the size representing the large amount of toilet paper being larger than a size of a normal amount of toilet paper for use at defecation.

When the unacceptable matter determination part 212 determines that the unacceptable matter is, the communication control part 213 sends, to the flush water controller 3, a flow prohibition signal of prohibiting the flush water from flowing via the communication part 23. Thus, the flush water controller 3 enters a flow prohibition state of prohibiting the flush water from flowing into the bowl 101*a*. The communication control part 213 sets a flag F managing a flow state of the flush water to "1" in the flow prohibition state of the flush water controller 3.

Moreover, the communication control part 213 sends, to the flush water controller 3, a flow permission signal for placing the flush water controller in a flow permission state of permitting the flush water to flow into the bowl 101*a* in response to pushing of the switch 24 in the flow prohibition state. The communication control part 213 sets the flag Fl to "0" in the flow permission state of the flush water controller 3.

For instance, the memory 22 includes a storage device, such as a RAM (Random Access Memory), an SSD (Solid State Drive) or a flash memory, for storing various kinds of information. The memory 22 stores, for example, the flag F.

The communication part 23 includes a communication circuit having operability of communicably connecting the controller 2 to the flush water controller 3 via a communication channel 60. The communication channel 60 is a wired or wireless communication channel. The wireless communication channel includes, for example, a wireless LAN, such as Wi-Fi (registered trademark), and a near field communication, such as the Bluetooth (registered trademark). The communication channel may include, for example, a communication channel defined by IEEE 802.3. The communication part 23 sends the flow prohibition signal and the flow permission signal under the control by the communication control part 213.

The communication part 23 further includes operability of connecting the controller 2 to a network 5. The network 5 includes, for example, the internet. The communication part 23 transmits excretion history information to the server 4. The excretion history information associates excretion (defecation, flatulating, urination, and a combination of defecation and flatulating) and daily time information about a date and time when the excretion occurred with each other. For instance, the processor 21 may generate the excretion history information per day, and transmit the generated excretion history information to the server 4.

The switch 24 is physically disposed in a specific position of a housing of the controller 2 so as to be pushed by the user for releasing the flow prohibition state.

Figure 3:
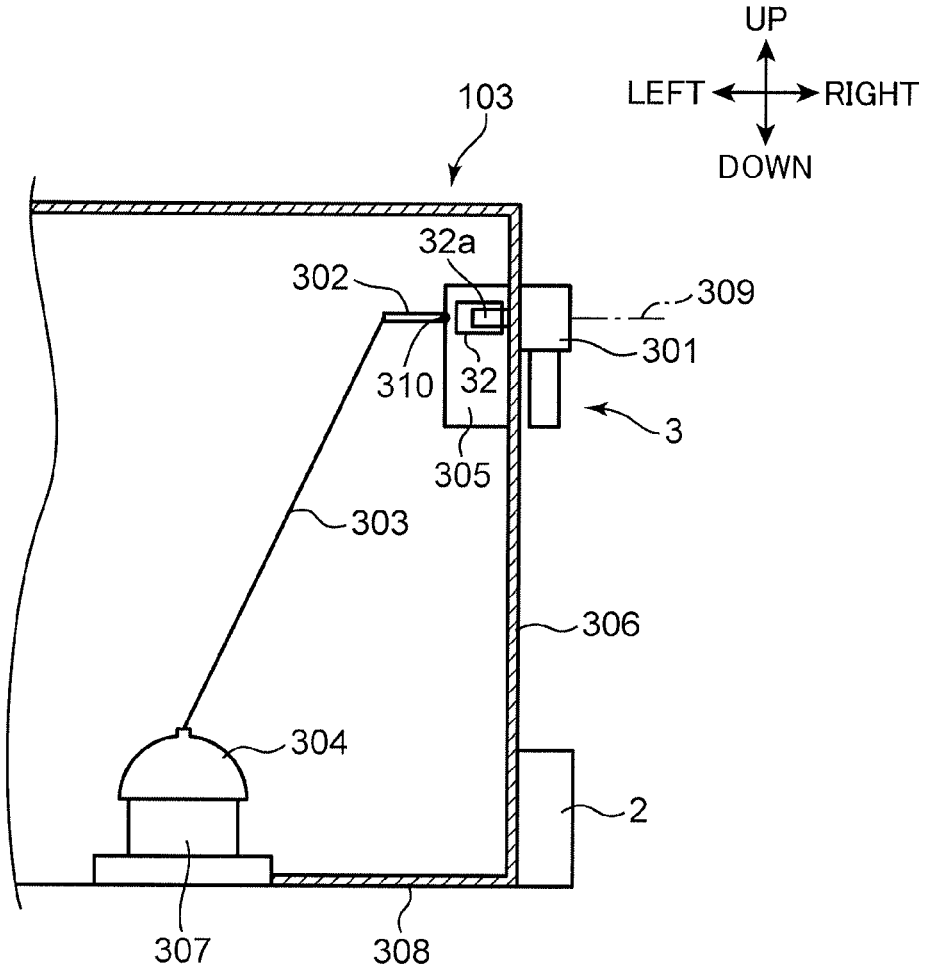
FIG. 3 shows an internal structure of a water reservoir tank.

The flush water controller 3 controls the flow of the flush water into the toilet 101. FIG. 3 shows an inner structure of the water reservoir tank 103. FIG. 3 shows an inner portion of the water reservoir tank 103 in a front view of the toilet 101. In FIG. 3, in the front view of the toilet 101, the left side thereof is defined as a left side, leftward or left direction, the right side thereof is defined as a right side, rightward or right direction, the upper side thereof is defined as an upper side, upward or up direction, and the lower side thereof is defined as a lower side, downward or down direction. The water reservoir tank 103 reserves the flush water. The water reservoir tank 103 has a side wall 306 and a bottom wall 308.

The flush water controller 3 includes a shifter 32, a lever 301, a relay rod 302, a chain 303, a rubber float 304, and a main body 305.

The lever 301 is located at a predetermined position of an upper portion of the side wall 306 and on an outside of the side wall 306. The lever 301 is attached to the side wall 306 rotatably about a rotational axis 309 perpendicularly intersecting the side wall 306.

The main body 305 is attached to the side wall 306 in an inside thereof to face the lever 301. The main body 305 includes a mechanical section (not shown) for changing a rotational movement of the lever 301 to a vertical movement of the relay rod 302. The rubber float 304 is connected to the main body 305 via the relay rod 302 and the chain 303. The relay rod 302 is made of hard material, e.g., metal or resin. The relay rod 302 is attached to the main body 305 rotatably about a rotary shaft 310 perpendicularly intersecting the paper in the up-down direction.

The chain 303 has one end attached to the relay rod 302 and another end attached to a top of the rubber float 304. The rubber float 304 has a dome shape and is configured to close an outlet hole 307 formed in the bottom wall 308 of the water reservoir tank 103. The outlet hole 307 communicates with a pipe (not shown) for supplying the flush water into the bowl 101*a*.

When the lever 301 is rotated about the rotational axis 309, the mechanical section of the main body 305 pulls up the relay rod 302. Accordingly, the chain 303 opens the rubber float 304 to permit the flush water in the water reservoir tank 103 to flow into the bowl 101*a* through the outlet hole 307 and flush the bowl 101*a*.

The shifter 32 is located in the main body 305 and includes a solenoid having a movable core 32*a*. When the shifter 32 receives electricity applied thereto, the movable core 32*a* slides rightward to push the lever 301 rightward. This releases engagement of the mechanical section of the main body 305 with the lever 301. Therefore, even when the lever 301 is rotated, its rotational force is not transmitted to the chain 303, and thus the rubber float 304 maintains a closed state. Consequently, the flush water in the water reservoir tank 103 is kept from flowing into the bowl 101*a*.

Contrarily, in no application of the electricity to the shifter 32, the movable core 32*a* returns to a home position. This causes the lever 301 to engage with the mechanical section of the main body 305. As a result, when the lever 301 is rotated, its rotational force is transmitted to the chain 303 to open the rubber float 304 and permit the flush water to flow into the bowl 101*a*.

Referring back to FIG. 1, the flush water controller 3 includes a state control part 31, the shifter 32, a communication part 33, and a memory 34. The state control part 31 includes an electric circuit, e.g., a CPU, or an ASIC. When the communication part 33 receives a flow prohibition signal, the state control part 31 accepts the application of the electricity to the shifter 32 to establish the flow prohibition state of prohibiting the flush water from flowing into the bowl 101*a*. When the communication part 33 receives a flow permission signal, the state control part 31 suspends the application of the electricity to the shifter 32 to establish the flow permission state of permitting the flush water to flow into the bowl 101*a*. The state control part 31 once having established the flow prohibition state maintains the flow prohibition state until receiving a next flow permission signal.

The shifter 32 includes, for example, a solenoid and prohibits the flush water from flowing into the bowl 101*a* under the control by the state control part 31.

The communication part 33 includes a communication circuit having operability of communicably connecting the flush water controller 3 to the controller 2 via the communication channel 60. The communication part 33 receives the flow prohibition signal and the flow permission signal from the controller 2.

The memory 34 includes a storage device, e.g., a RAM and a flash memory, and serves as a work memory of the state control part 31.

The server 4 receives the excretion history information transmitted by the controller 2.

The server 4 includes a database for storing the excretion history information.

For instance, a caregiver or carer uses the database in the server 4 when creating monitoring data of a care receiver. Specifically, a terminal device used by the caregiver acquires from the server 4 the excretion history information corresponding to identification information of the care receiver and creates the monitoring data of the care receiver. For example, the terminal device may create the monitoring data based on a frequency of flatulating in a predetermined period, a frequency of defecation in the predetermined period, a frequency of urination in the predetermined period, and a frequency of a combination of defecation and flatulating in the predetermined period. The predetermined period for the creation of the monitoring data may be one day, one week, or one month. For instance, the terminal device may create the monitoring data based on a time of each flatulating, defecation, urination, and each combination of defecation and flatulating in the predetermined period.

Figure 4:
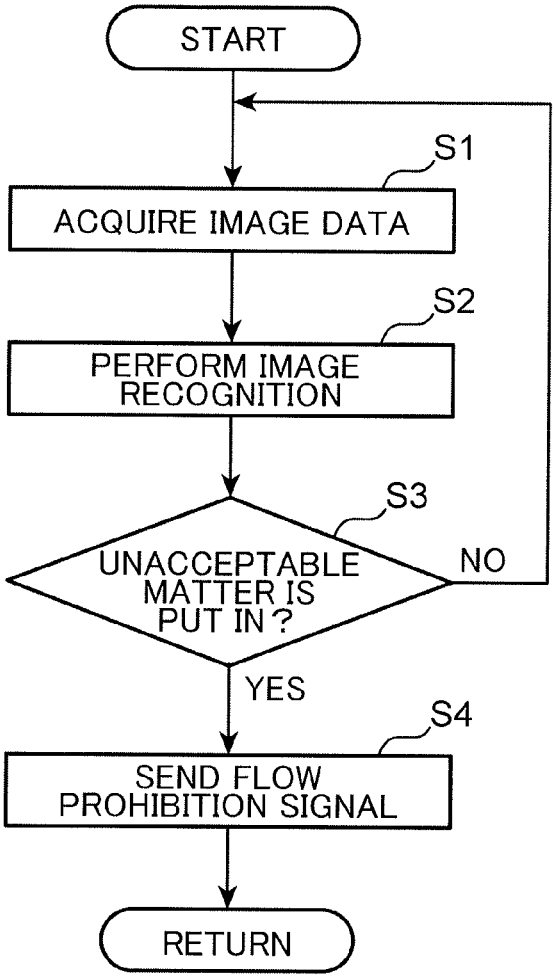
FIG. 4 is a flowchart showing an example of a process by the controller in the first embodiment of the disclosure.

Next, an operation by the controller 2 will be described. FIG. 4 is a flowchart showing an example of a process by the controller in the first embodiment of the disclosure. The process in the flowchart is executed in a predetermined sampling period. The sampling period may be the same as a image capturing period of the camera 1 or may be n-times ("n" is an integer equal to or greater than 2) as long as the image capturing sampling period.

In step S1, the image data acquisition part 211 acquires image data from the camera 1. In step S2, the unacceptable matter determination part 212 executes image recognition based on the image data, and determines whether an unacceptable matter is in the bowl 101*a*. Specifically, the unacceptable matter determination part 212 determines that an unacceptable matter is when the image data contains an image of an object having a predetermined size or larger except for stool and urine.

An example of a determination as to whether the image data includes a defecation or stool image will be described below. First, the unacceptable matter determination part 212 calculates difference image data indicating a difference between the image data acquired in step S1 and base image data. The base image data represents image data generated through calibration executed in arrangement of the sensor unit 105 to the toilet 101. The base image data is generated, for example, based on a plurality of pieces of color image data obtained by capturing images of the state of the bowl 101*a* without defecation and urination by the camera 1 a plurality of times. In other words, the base image data represents color image data obtained in a default state of the bowl 101*a* without defecation and urination. Therefore, image data containing an image of stool, urine, or an unacceptable matter is extractable by taking a difference between the base image data and the image data captured at defecation or urination.

Subsequently, the unacceptable matter determination part 212 calculates an RGB ratio among an R component, a G component, and a B component contained in the calculated difference image data. Then, the unacceptable matter determination part 212 calculates a distance between the calculated RGB ratio and a predetermined defecation reference ratio. The RGB ratio represents, for example, a ratio among a total value of the luminance of the R component, a total value of the luminance of the G component, and a total value of the luminance of the B component, in the difference image data. The defecation reference ratio represents a typical defecation RGB ratio calculated by analyzing a plurality of pieces of image data containing various defecation or stool images. For instance, the Euclidean distance is adopted for the distance. The unacceptable matter determination part 212 finally determines that the image data captured by the camera 1 contains a defecation image when the calculated distance is equal to or shorter than the reference distance.

The unacceptable matter determination part 212 may determine whether the image data contains a urination or urine image in the same manner as the process for the defecation image. Specifically, the unacceptable matter determination part 212 may calculate a distance between an RGB ratio contained in the difference image and a predetermined urination reference ratio, and determine that the image data captured by the camera 1 contains a urination image when the distance is equal to or shorter than the reference distance.

The unacceptable matter determination part 212 may determine that the image data contains an image of an unacceptable matter when it is determined that the image data contains neither the defecation image nor the urination image and the difference image has the predetermined size or larger.

When the unacceptable matter determination part 212 determines in step S3 that an unacceptable matter is in the bowl 101*a* (YES in step S3), the communication control part 213 sends a flow prohibition signal to the flush water controller 3 via the communication part 23 (step S4). Contrarily, when the unacceptable matter determination part 212 determines that no unacceptable matter is in the bowl 101*a* (NO in step S3), the process returns to step S1. When step S4 is finished, the process returns to step S1. Accordingly, the flush water controller 3 enters the flow prohibition state. Thereafter, the flush water controller 3 maintains the flow prohibition state until the unacceptable matter is removed from the bowl 101*a* and the switch 24 is pushed.

As described heretofore, the controller 2 in the first embodiment can prohibit the flush water from flowing immediately after detection of an unacceptable matter. This consequently succeeds in prohibiting the flush water from flowing after the unacceptable matter is put and before the flush water starts to flow, and thus preventing the flush water from overflowing from the toilet 101 and keeping the toilet 101 from being clogged with the unacceptable matter.

Second Embodiment

Figure 5:
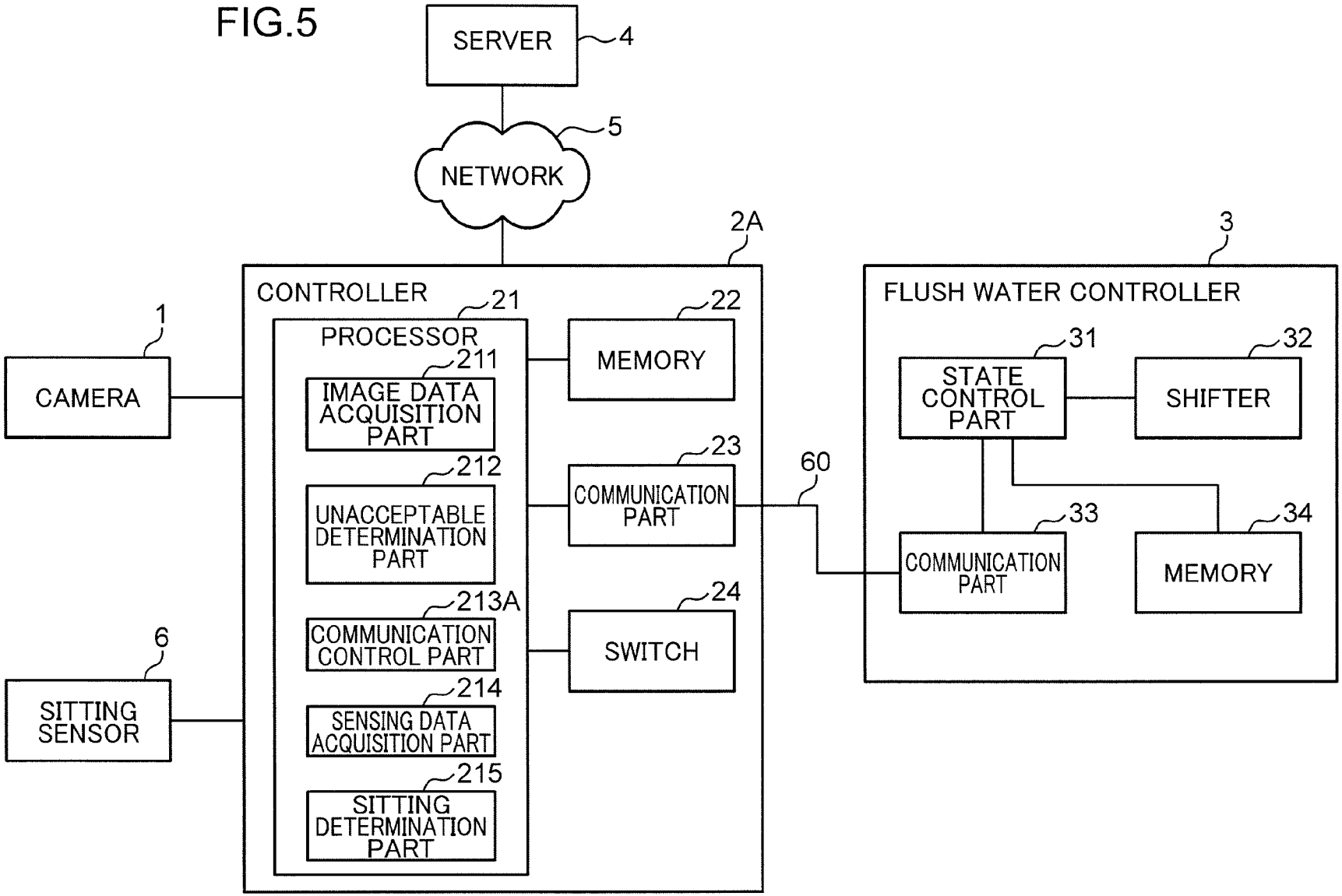
FIG. 5 shows a configuration of an excretion management system in a second embodiment of the disclosure.

A second embodiment aims at placing a flush water controller 3 in a flow prohibition state after confirming sitting of a user. FIG. 5 shows a configuration of an excretion management system in the second embodiment of the disclosure. In the second embodiment, elements which are the same as those in the first embodiment are given the same reference numerals, and thus explanation therefor will be omitted.

A controller 2A is further connected to a sitting sensor 6 in comparison with the controller 2. The sitting sensor 6 is arranged in the sensor unit 105 to detect whether a user sits on a toilet seat 102. The sitting sensor 6 is communicably connected to the controller 2A. The sitting sensor 6 includes an illuminance sensor which detects an illuminance of a periphery of a bowl 101*a*, and a distance measurement sensor which detects a distance to a certain object at the periphery of the bowl 101*a*. When the user sits on a toilet seat 102, an opening section is closed by the buttocks thereof. Therefore, the periphery of the bowl 101*a* gets dark, and this means that an object exists in the vicinity of the sensor unit 105. In this way, use of the illuminance sensor and the distance measurement sensor leads to achievement of detecting whether the user sits on the toilet seat 102. The sitting sensor 6 may include a pressure sensor which detects a pressure of the user on the toilet seat 102, in place of the illuminance sensor and the distance measurement sensor. When the sitting sensor 6 includes the pressure sensor, the sitting sensor 6 is disposed at the toilet seat 102. Alternatively, the sitting sensor 6 may include either the illuminance sensor or the distance measurement sensor.

A processor 21 of the controller 2A further includes a communication control part 213A, a sensing data acquisition part 214, and a sitting determination part 215 in comparison with the controller 2.

The sensing data acquisition part 214 acquires sensing data from the sitting sensor 6. The sensing data includes the illuminance detected by the illuminance sensor and the distance to the object detected by the distance measurement sensor. When the sitting sensor 6 includes the pressure sensor, the sensing data contains a pressure value detected by the pressure sensor.

The sitting determination part 215 determines, based on a detection result from the sitting sensor 6, whether the user sits on the toilet seat 102. For instance, the sitting determination part 215 may determine that the user sits on the toilet seat when the illuminance detected by the illuminance sensor of the sitting sensor 6 is smaller than a reference illuminance and the distance to the object detected by the distance measurement sensor of the sitting sensor 6 is shorter than a reference distance. However, this is a mere example, and the sitting determination part 215 may determine that the user sits on the toilet seat 102 by using the detection result from either the illuminance sensor or the distance measurement sensor, or may determine that the user sits on the toilet seat 102 when the pressure detected by the pressure sensor is equal to or larger than the reference pressure.

When the unacceptable matter determination part 212 determines that an unacceptable matter is and the sitting determination part 215 determines that no user sits on the toilet seat 102, the communication control part 213A sends a flow prohibition signal to the flush water controller 3 via a communication part 23. Contrarily, when the unacceptable matter determination part 212 determines that the unacceptable matter is and the sitting determination part 215 determines that the user sits on the toilet seat 102, the communication control part 213A suspends sending of the flow prohibition signal.

Figure 6:
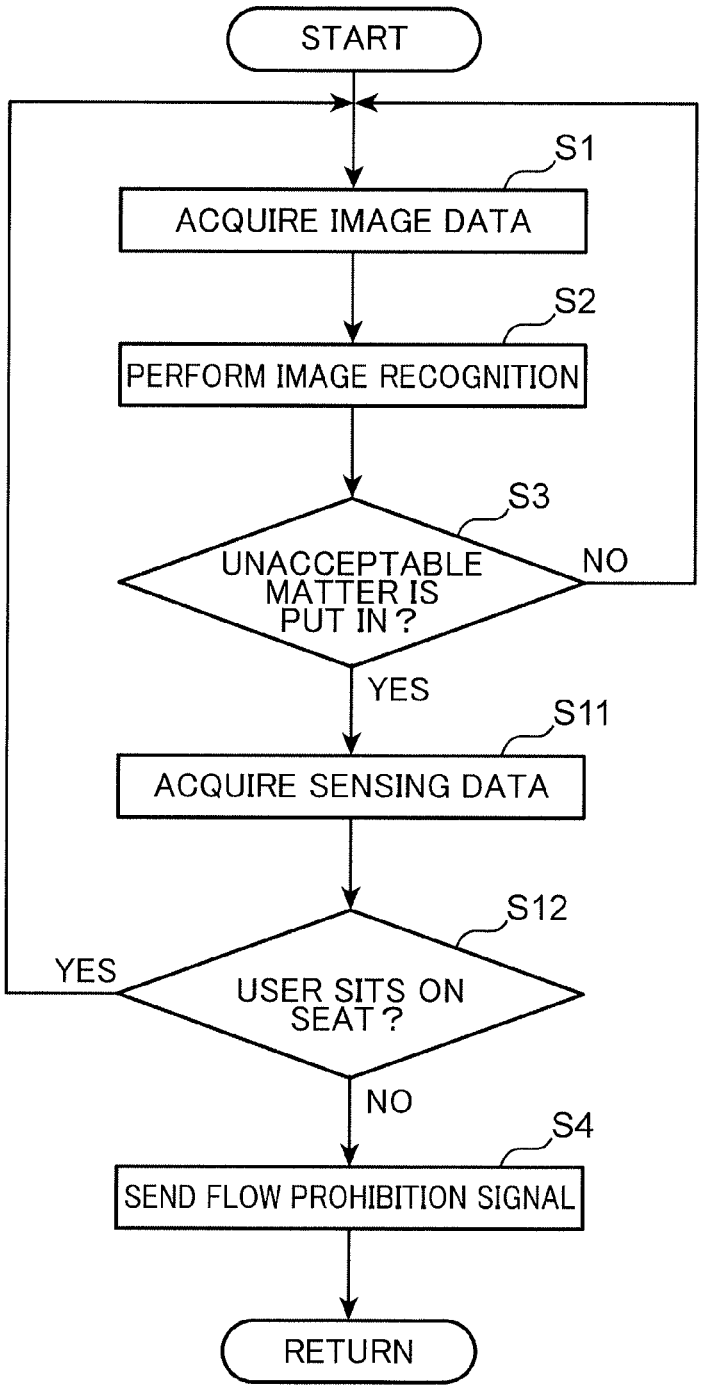
FIG. 6 is a flowchart showing an example of a process by a controller in the second embodiment of the disclosure.

Next, a process by the controller 2A in the second embodiment will be described. FIG. 6 is a flowchart showing an example of the process by the controller 2A in the second embodiment of the disclosure. In the flowchart in FIG. 6, steps which are the same as those in FIG. 4 are given the same reference numerals.

In step S11 subsequent to step S3 in a case of "YES" therein, the sensing data acquisition part 214 acquires sensing data from the sitting sensor 6. In step S12, the sitting determination part 215 determines, based on the sensing data acquired by the sensing data acquisition part 214, whether a user sits on the toilet seat 102.

When the sitting determination part 215 determines that no user sits on the toilet seat 102 (NO in step S12), the communication control part 213A sends a flow prohibition signal to the flush water controller 3 via the communication part 23 (step S4).

Contrarily, when the sitting determination part 215 determines that a user sits on the toilet seat 102 (YES in step S12), the process returns to step S1.

An unacceptable matter is highly likely to put in the bowl 101*a* in a state where no user sits on the toilet seat. The controller 2A in the second embodiment suspends sending of the flow prohibition signal unless the user sits on the toilet seat 102 even at acquisition of an image recognition result showing that an unacceptable matter is. Therefore, the controller 2A in the second embodiment results in preventing the flow prohibition signal from being sent regardless of, actually, no unacceptable matter. In addition, detection accuracy of such an unacceptable matter is increased.

Third Embodiment

Figure 7:
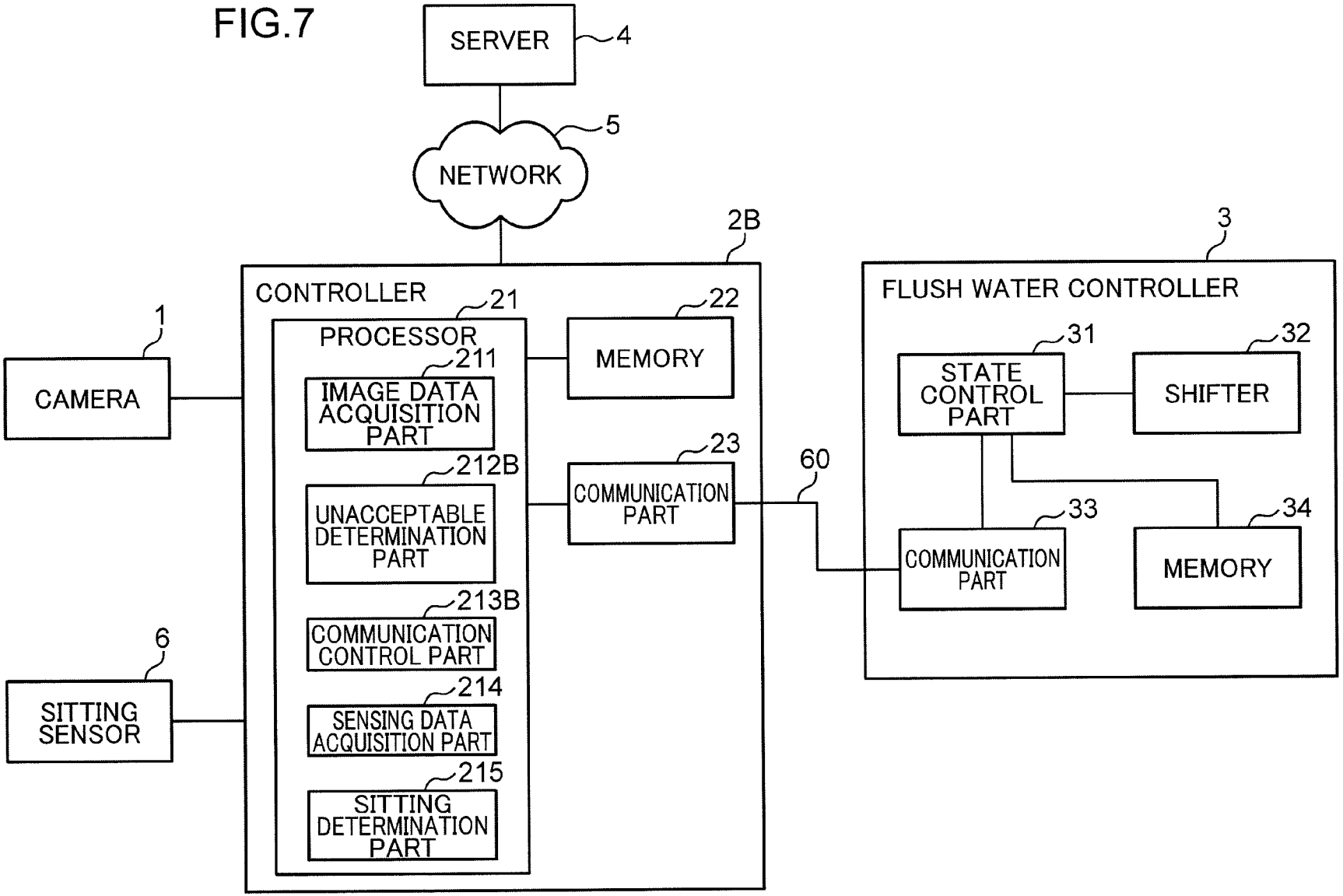
FIG. 7 shows a configuration of an excretion management system in a third embodiment of the disclosure.

A third embodiment aims at allowing a flush water controller 3 to automatically restore a flow permission state after an unacceptable matter is removed. FIG. 7 shows a configuration of an excretion management system in the third embodiment of the disclosure. In the third embodiment, elements which are the same as those in the first and second embodiments are given the same reference numerals, and thus explanation therefor will be omitted.

A controller 2B in the third embodiment is based on the controller 2A. In the third embodiment, the controller 213 excludes the switch 24 owing to a determination automatically made as to whether an unacceptable matter has been removed. An unacceptable matter determination part 212B determines, after determining that an unacceptable matter is in a bowl 101*a*, whether the unacceptable matter has been removed from the bowl 101*a* by executing image recognition based on image data acquired by an image data acquisition part 211. In detail, the unacceptable matter determination part 212B calculates a difference image between image data captured by a camera 1 and base image data, and determines that the unacceptable matter has been removed from the bowl 101*a* when the difference image does not contain an image of an object having a predetermined size or larger except for stool and urine.

When the unacceptable matter determination part 212B determines that the unacceptable matter has been removed, a communication control part 213B sends a flow permission signal to the flush water controller 3 via a communication part 23.

Figure 8:
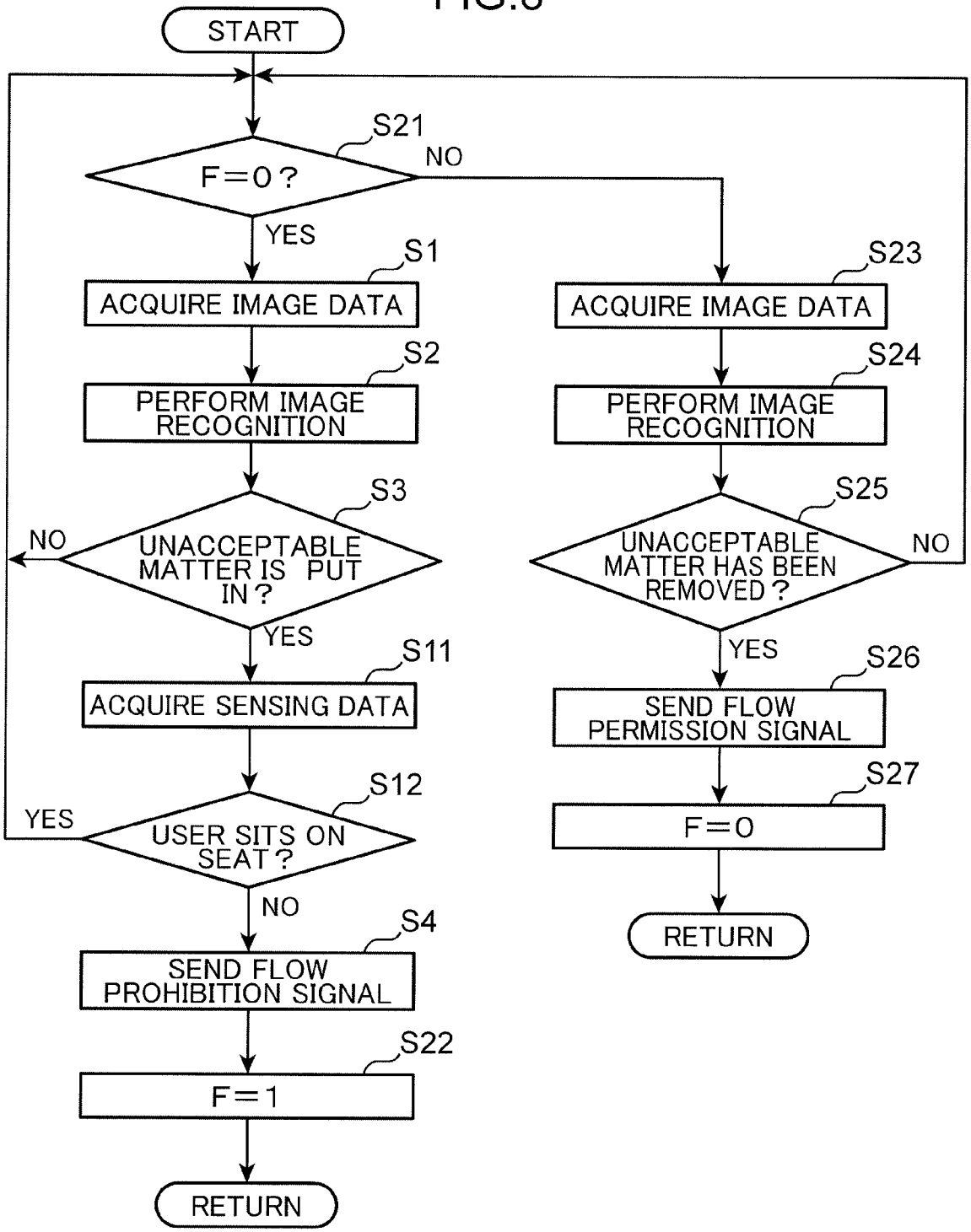
FIG. 8 is a flowchart showing an example of a process by a controller in the third embodiment of the disclosure.

Next, a process by the controller 2B in the third embodiment will be described. FIG. 8 is a flowchart showing an example of the process by the controller 213 in the third embodiment of the disclosure. In the flowchart in FIG. 8, steps which are the same as those in FIG. 6 are given the same reference numerals.

In step S21, the communication control part 213B determines whether a flag F indicates "0". When the flag F indicates "0" (YES in step S21), the process proceeds to step S1. Specifically, when the flush water controller 3 is in a flow permission state, the process proceeds to steps S1, S2, S3, S1, S12, S4 in the same manner as the process in the second embodiment. In step S22 subsequent to step S4, the communication control part 213B sets the flag F to "1" in accordance with sending of a flow prohibition signal. When step S22 is finished, the process returns to step S21.

Contrarily, when the flag F indicates "1" (NO in step S21), the process proceeds to step S23. Specifically, when the flush water controller 3 is in a flow prohibition state, step S23 and the subsequent steps are executed.

In step S23, an image data acquisition part 211 acquires image data from a camera 1. In step S24, the unacceptable matter determination part 212B performs image recognition based on the image data to determine whether the unacceptable matter has been removed.

When the unacceptable matter determination part 212B determines in step S25 that the unacceptable matter has been removed (YES in step S25), the communication control part 213B sends a flow permission signal to the flush water controller 3 via the communication part 23 (step S26).

In step S27, the communication control part 21313 sets the flag F to "0" in accordance with the sending of the flow permission signal. When step S27 is finished, the process returns to step S21.

Contrarily, when the unacceptable matter determination part 212B determines that the unacceptable matter has not been removed (NO in step S25), the process returns to step S21.

As described heretofore, the controller 2B in the third embodiment allows the flush water controller 3 in the flow prohibition state to automatically restore the flow permission state after the unacceptable matter is removed. Consequently, the flush water controller 3 achievably restores the flow peunission state immediately after the unacceptable matter is removed.

Fourth Embodiment

Figure 9:
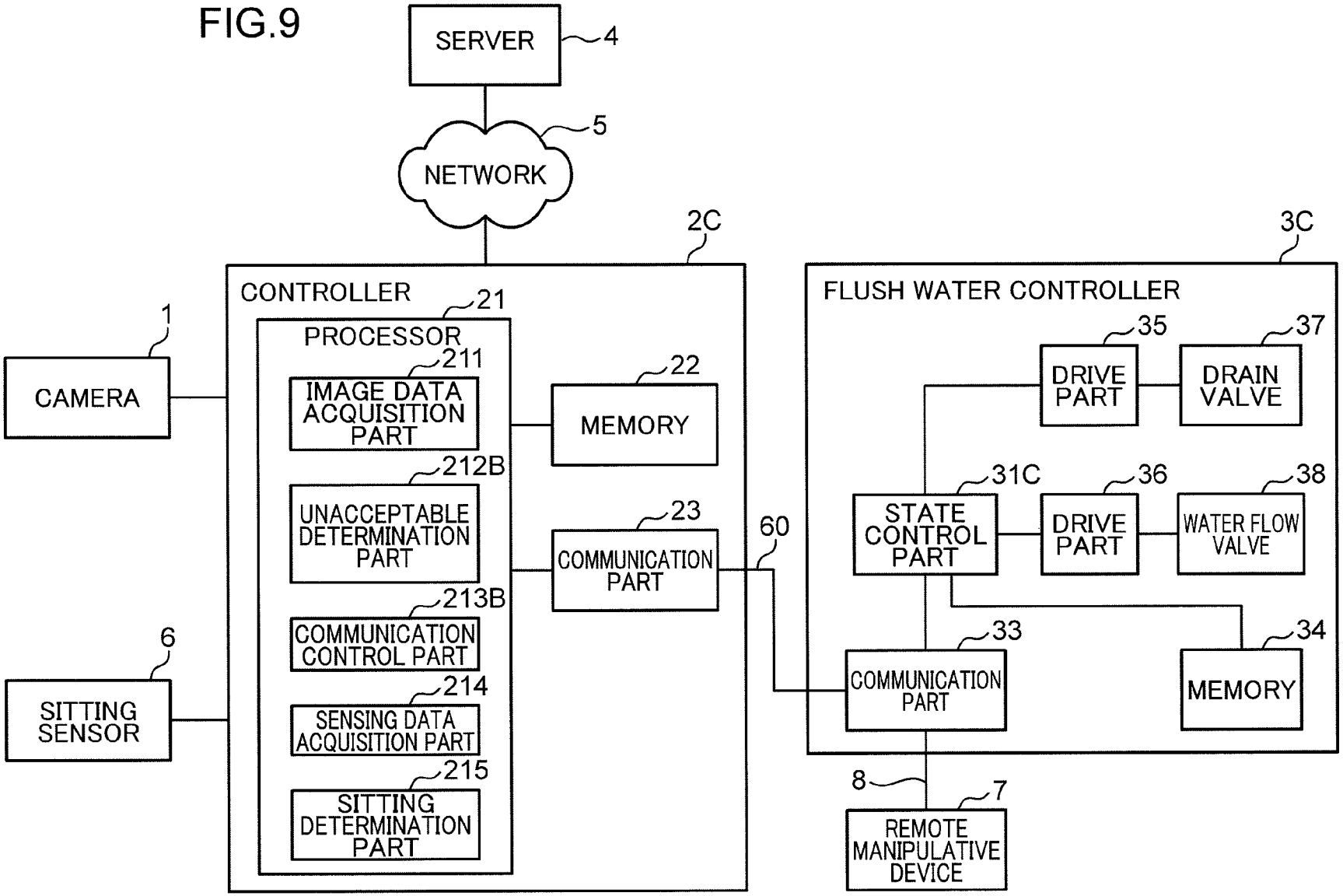
FIG. 9 shows a configuration of an excretion management system in a fourth embodiment of the disclosure.

FIG. 9 shows a configuration of an excretion management system in a fourth embodiment of the disclosure. In the fourth embodiment, a controller 2C is adopted for a flush water controller 3*c* that receives an instruction of the flow of flush water from a remote manipulative device 7. In the fourth embodiment, elements which are the same as those in the first to third embodiments are given the same reference numerals, and thus explanation therefor will be omitted.

The controller 2C has the same configuration as the controller 2B.

The remote manipulative device 7 is communicably connected to the flush water controller 3C via a communication channel 8. The communication channel 8 can adopt a wireless LAN, and a near field communication like the Bluetooth (registered trademark), and a wired LAN like IEEE 802.3. The remote manipulative device 7 includes a waterflow button of instructing the flush water controller 3C to cause the flush water to flow into the bowl 101*a*. The remote manipulative device 7 sends a waterflow instruction signal to the flush water controller 3C in response to pushing of the waterflow button by a user.

The flush water controller 3C additionally includes a drive part 35, a drive part 36, a drain valve 37, and a waterflow valve 38, and excludes the shifter 32 in comparison with the flush water controller 3.

When a communication part 33 receives the waterflow instruction signal, a state control part 31C inputs a valve-opening instructive signal to the drive part 35 to cause the drive part 35 to open the drain valve 37. After a lapse of a predetermined time from the input of the valve-opening instructive signal to the drive part 35, the state control part 31C may input a valve-closing instructive signal to the drive part 35 to cause the drive part 35 to close the drain valve 37.

When the communication part 33 receives the waterflow instruction signal, the state control part 31C inputs a valve-opening instructive signal to the drive part 36 to cause the drive part 36 to open the waterflow valve 38. After a lapse of a predetermined time from the input of the valve-opening instructive signal to the drive part 36, the state control part 31C may input a valve-closing instructive signal to the drive part 36 to cause the drive part 36 to close the waterflow valve 38.

The drive part 35 includes, for example, a motor, and operates to open the drain valve 37 in response to the input of the valve-opening instructive signal from the state control part 31C, and close the drain valve 37 in response to the input of the valve-closing instructive signal from the state control part 31C.

The drive part 36 includes, for example, a motor, and operates to open the waterflow valve 38 in response to the input of the valve-opening instructive signal from the state control part 31C, and close the waterflow valve 38 in response to the input of the valve-closing instructive signal from the state control part 31C.

The drain valve 37 is provided at a bottom of a bowl 101*a* to open to enable a drain hole formed in the bottom of the bowl 101*a* and a sewage pipe to communicate with each other.

The waterflow valve 38 is configured to close an outlet hole 307 formed in a bottom wall 308 of a water reservoir tank 103. The waterflow valve 38 opens to supply the flush water in the water reservoir tank 103 into the bowl 101*a*.

The state control part 31C opens the waterflow valve 38 concurrently with opening the drain valve 37. In this manner, the flush water causes stool and urine excreted in the bowl 101*a* to flow to the sewage pipe.

When the controller 2C sends a flow prohibition signal, the state control part 31C places the flush water controller 3C in an flow prohibition state. When the communication part 33 receives a waterflow instruction signal from the remote manipulative device 7 in the flow prohibition state, the state control part 31C avoids inputting the valve-opening instructive signal to each of the drive part 35 and the drive part 36. This prohibits the drain valve 37 and the waterflow valve 38 from opening. Therefore, when an unacceptable matter is in the bowl 101*a*, the flush water is prevented from flowing into the bowl 101*a*. This consequently prevents the flush water from overflowing, and keeps the toilet from being clogged with the unacceptable matter.

In contrast, when the controller 2C sends a flow permission signal, the state control part 31C places the flush water controller 3C in a flow permission state. Moreover, when the communication part 33 receives a waterflow instruction signal from the remote manipulative device 7 in the flow permission state, the state control part 31C inputs a valve-opening instructive signal to each of the drive part 35 and the drive part 36. This permits the drain valve 37 and the waterflow valve 38 to open. As a result, when no unacceptable matter is in the bowl 101*a*, the flush water is permitted to flow into the bowl 101*a* to allow the stool and the urine to flow to the sewage pipe.

This disclosure can adopt modifications described below.

(1) The unacceptable matter determination part 212 may determine whether an unacceptable matter is by applying pattern matching based on a reference image of an unacceptable matter, such as a paper diaper, a paper cup, and a large amount of toilet paper, onto image data captured by the camera 1. Each of the unacceptable matter determination parts 212A, 212B, and 212C may adopt this determination way as well.

(2) The controller 2B in the third embodiment may be based on the controller 2.

(3) The shifter 32 may not include a solenoid. For instance, referring to FIG. 3, the flush water controller 3 may include a gear for the lever 301 and a gear for the relay rod 302 to engage with the gear for the lever 301. The relay rod 302 may be configured to pull up the rubber float 304 when the lever 301 is rotated, and its rotational force is transmitted via the gear for the lever and the gear for the relay rod to cause the relay rod to rotate in the up-down direction. In this case, the shifter 32 may include a motor to release the engagement between the gear for the lever and the gear for the relay rod.

Alternatively, the flush water controller 3 may include a sensor which detects the rotation of the lever 301, and a motor to pull up the relay rod 302 by operating upon receiving a drive signal from the state control part 31 in response to detection of the rotation of the lever 301. In this case, the state control part 31 may suspend outputting of the drive signal to the motor even at the detection of the rotation of the lever 301 by the sensor in the flow prohibition state.

INDUSTRIAL APPLICABILITY

This disclosure achieves immediate detection of an unacceptable matter put in a toilet, and therefore is useful in a technical filed of toilets.

The invention claimed is:

1. A flush water control method for a controller communicably connected to a flush water controller that controls a flow of flush water into a toilet of a flush type, the flush water control method comprising:

acquiring image data captured by a camera which is located at the toilet to capture an image of a bowl of the toilet;

determining whether an unacceptable matter being an object having a possibility of clogging the toilet is in the bowl by performing image recognition based on the image data; and sending, to the flush water controller, a flow prohibition signal of prohibiting the flush water from flowing when it is determined that the unacceptable matter is in the bowl.

2. The flush water control method according to claim 1, further comprising:

acquiring sensing data from a sensor which detects whether a user sits on the toilet;

determining whether a user sits on the toilet by using the sensing data when it is determined that the unacceptable matter is in the bowl; and sending the flow prohibition signal when it is determined that no user sits on the toilet, and suspending sending of the flow prohibition signal when it is determined that a user sits on the toilet.

3. The flush water control method according to claim 1, further comprising:

determining whether the unacceptable matter has been removed from the bowl by performing the image recognition based on the image data after sending the flow prohibition signal; and sending, to the flush water controller, a flow permission signal of permitting the flush water to flow when it is determined that the unacceptable matter has been removed.

4. The flush water control method according to claim 1, wherein, in the determining of the unacceptable matter, when the image data contains an image of an object having a predetermined size or larger except for stool and urine, the object is determined as the unacceptable matter.

5. The flush water control method according to claim 1, wherein, the image data includes color image data having a plurality of color components, and in the determining of the unacceptable matter, a difference image between base image data indicating a state of the bowl having no stool, urine, and unacceptable matter, and the image data is calculated, and it is determined, based on luminance of each of the color components of the difference image, whether the image data contains an image of stool and urine.

6. The flush water control method according to claim 1, wherein the unacceptable matter includes a diaper.

7. A controller communicably connected to a flush water controller that controls a flow of flush water into a toilet of a flush type, the controller comprising:

an image data acquisition part that acquires image data captured by a camera which is located at the toilet to capture an image of a bowl of the toilet;

an unacceptable matter determination part that determines whether an unacceptable matter being an object having a possibility of clogging the toilet is in the bowl by performing image recognition based on the image data; and a communication control part that sends, to the flush water controller, a flow prohibition signal of prohibiting the flush water from flowing when the unacceptable matter determination part determines that an unacceptable matter is in the bowl.

8. A non-transitory computer-readable recording medium storing A flush water control program for causing a computer to serve as a controller communicably connected to a flush water controller that controls a flow of flush water into a toilet of a flush type, the flush water control program causing the computer to:

acquire image data captured by a camera which is located at the toilet to capture an image of a bowl of the toilet;

determine whether an unacceptable matter being an object having a possibility of clogging the toilet is in the bowl by performing image recognition based on the image data; and send, to the flush water controller, a flow prohibition signal of prohibiting the flush water from flowing when it is determined that the unacceptable matter is in the bowl.

* * * * *